United States Patent [19]

Royce

[11] Patent Number: 4,801,274

[45] Date of Patent: Jan. 31, 1989

[54] MICROWAVE COAXIAL CONNECTOR DEVICE

[75] Inventor: Norman D. Royce, San Carlos, Calif.

[73] Assignee: Hewlett-Packard Company, Palo Alto, Calif.

[21] Appl. No.: 144,286

[22] Filed: Jan. 15, 1988

[51] Int. Cl.[4] ..... H01R 13/623

[52] U.S. Cl. ..... 439/322; 439/320

[58] Field of Search ..... 439/312–323; 285/386–388

[56] References Cited

U.S. PATENT DOCUMENTS

| | | | |
|---|---|---|---|
| 2,531,021 | 11/1950 | Bard | 285/388 |
| 2,616,942 | 11/1952 | Simpson et al. | 439/320 |
| 3,546,658 | 12/1970 | Van Horssen et al. | 439/320 |

*Primary Examiner*—Eugene F. Desmond

*Attorney, Agent, or Firm*—Bradley A. Perkins; Edward Y. Wong; William H. F. Howard

[57] ABSTRACT

A microwave coaxial connector comprises an inner conductor, an outer conductor, a coupling nut, ball bearings mechanically coupling the outer conductor and the coupling nut, and a C-ring. Inward threads of the coupling connector engage outward threads of a receiving connector. Frictional relative rotation of mating faces of the outer conductor and the receiving connector is alleviated since the ball bearings decouple friction between the nut and the outer conductor. The nut includes an aperture which can be aligned with a groove in the outer conductor for positioning ball bearings with the C-ring removed. With the C-ring in place on the outer conductor, the aperture is forward of and inaccessible to the ball bearings.

2 Claims, 1 Drawing Sheet

MICROWAVE COAXIAL CONNECTOR DEVICE

BACKGROUND OF THE INVENTION

The present invention relates to microwave test equipment and, more particularly, to a connector for microwave test devices. A major objective of the present invention is to provide a microwave connector suitable for multiple precision connections.

Precision microwave equipment needs to be tested and calibrated, usually by the manufacturer before distribution and sale. Testing such equipment typically involves interfacing with microwave test equipment. The required interfacing can be effected using microwave coaxial lines and microwave coaxial connectors.

Concentional microwave coaxial connectorss can include an inner conductor, an outer conductor and an inwardly threaded nut. The inwardly threaded nut is designed to engage an outwardly threaded mating connector. Front faces of reespective inner conductors and outer conductors contact each other at a reference plane once the nut is threaded onto the receiving outer conductor. To permit machining of the conductors, a moderately soft conductor material, such as beryllium-copper alloy, is used. To maximize performance, the inner and outer conductors can be gold plated. The gold provides optimal conductivity and resistance to oxidation and other forms of corrosion.

One problem with using a soft conductor material and with using gold plating, which is also soft, is that the device is susceptible to scratches and gouges. The resulting surface defects can impair performance seriously. For example, a microwave signal can be disturbed significantly by imperfections in contact at the reference plane between mating connectors.

While damage can be negligible for connectors which are connected once or twice and then left undisturbed, it is serious for test devices where a connector is connected and disconnected many times. Inevitably, the connection process abrades the front faces of connectors. Often coupling nuts are mounted in such a way that a scratched mating face cannot be repaired. Accordingly, the abrasion requires disposal of the damaged connector. Where the connector is permanently mounted to a test device, a scratch can require discarding of the entire device.

What is needed is a microwave coaxial connector which minimizes damage to critical surfaces without sacrificing the advantages of using gold plating and machinable materials for the conductors. Preferably, such a connector would allow access for repairing damaged surfaces and disassembly for salvaging expensive intact components when a mechanically coupled damaged component cannot be repaired readily.

SUMMARY OF THE INVENTION

The present invention is founded on experimental analysis of microwave coaxial connectors that have been repeatedly engaged and disengaged. This analysis indicates that most of the damage to the critical front faces of outer conductors is not due simply to the forced contact between faces as the coupling nut is tightened. The most severe damage is produced by unintended rotational motion between contacting faces. This rotational motion is caused by friction between the coupling nut and the outer conductor on which it is mounted. Thus, the contact faces not only press against each other, but actually grind into each other. Furthermore, any particles trapped between the faces scrape each face, destroying the planarity of both.

In accordance with the present invention, an outer conductor and a coupling nut are configured to incorporate ball bearings therebetween to minimize frictional engagement as the nut is tightened down on a receiving connector. The ball bearings are placed between an outer surface of the outer conductor and an inner surface of the nut.

The outer conductor includes a flange or other feature in front of the ball bearings to limit their forward movement. Herein, the mating end of a connector is the "front". The nut includes a ring-shaped ridge or other feature for limiting the rearward movement of the ball bearings. Preferably, the conductor and nut conform to the ball bearings where mechanical coupling occurs. The outer conductor also includes a flange or other feature for limiting the rearward movement of the nut. The forward movement of the nut is limited by the ball bearings.

The outer conductor has a circumferential groove in which the ball bearings are placed. Access to the groove can be had through an aperture in the nut. The aperture can be disposed over the groove temporarily by retracting the nut rearward relative to the outer conductor. The ball bearings can then be placed in the groove by dropping them through the aperture. Once the ball bearings are inplace, the nut can be pushed forward. A retainer such as a C-ring can then be positioned to prevent the rearward movement of the nut. The retainer keeps the aperture inaccessible to the ball bearings during normal operation of the connector. Preferably, the retainer is removable so that the connector can be readily removed for repair and salvage.

The ball bearings minimize friction between the nut and the outer conductor to which it is coupled. As a result, relative rotation of mating faces is minimized as the nut is tightened. Thus, damage to mating faces is minimized. As an additional advantage, torque-induced stress on cables and devices mechanically coupled to the connectors is minimized. The preferred retainer and aperture arrangement provides for ready assembly and disassembly for further convenience and cost savings. Other features and advantages of the present invention are apparent in view of the description below with reference to the following drawing.

DESCRIPTION OF THE PREFERRED EMBODIMENTS

Figure 1:
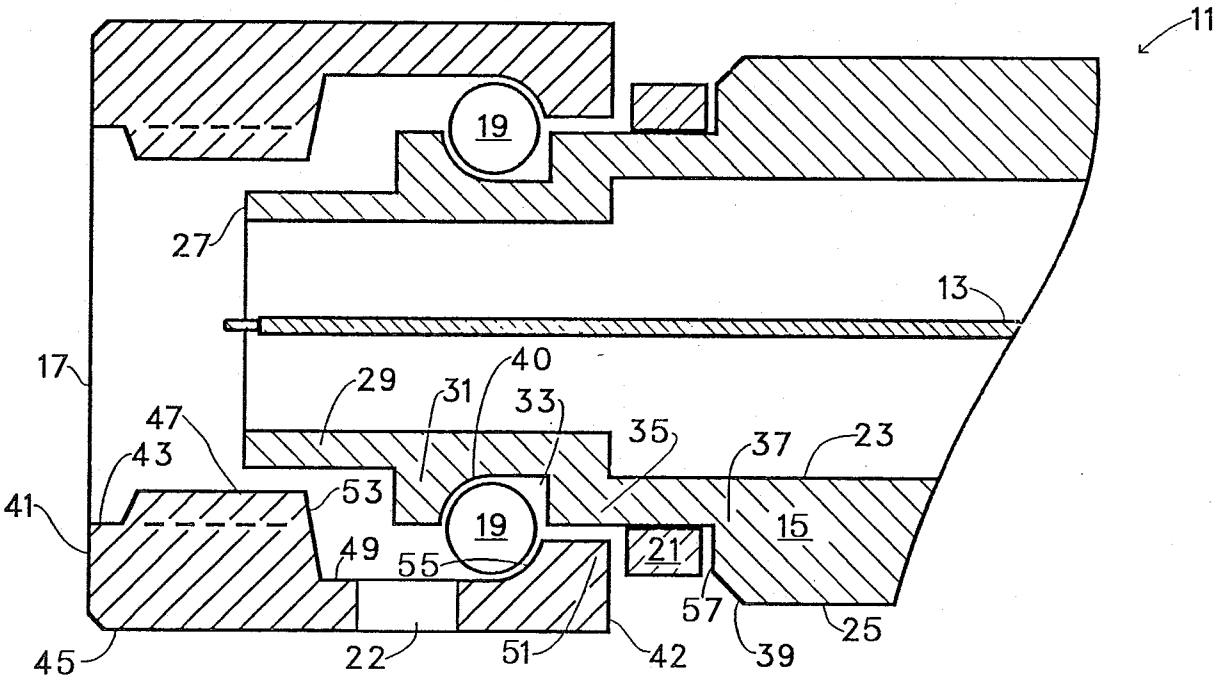
FIG. 1 is a sectional view of a microwave coaxial connector in accordance with the present invention.

In accordance with the present invention, a microwave coaxial connector 11 comprises an inner conductor 13, an outer conductor 15, a coupling nut 17, ball bearings 19 and a C-ring 21, as shown in FIG. 1. The inner and outer conductors define a coaxial transmission line therebetween. Nut 17 includes an aperture 22 large enough for ball bearings 19 to pass through when C-ring 21 is removed and nut 17 is pulled back so that aperture 22 is aligned with the illustrated position for ball bearings 19.

Outer conductor 15 is primarily of beryllium-copper alloy and is gold plated for optimal conductivity and corrosion resistance. Outer conductor 15 has an inner surface 23 and an outer surface 25. Outer surface 25 defines, from front to back, a front face 27, a front cylinder 29, an outward flange 31, a groove 33, a step 35, and a rear cylinder 37. Rear cylinder 37 has a bevel 39 to facilitate placement of C-ring 21. Ball bearings 19 are seated in groove 33. A curved wall 40 which is the rear surface of outward flange 31 and the front surface of groove 33, limits the forward movement of ball bearings 19.

Coupling nut 17 has a front face 41, a rear face 42, an inner surface 43, and an outer surface 45. Inner surface 43 includes a threaded segment 47, a groove 49 and an inward flange 51. Aperture 22 is located between a slanted front wall 53 of groove 49 and a concave rear wall 55 of groove 49. Concave rear wall 55 limits the rearward travel of ball bearings 19.

Ball bearings 19 are small steel spheres. They can contact with outer conductor 15 and nut 17 directly or through a thin layer of lubricant. In either case, ball bearings 19 are mechanically coupled to outer conductor 15 and nut 17 in a way that minimizes friction. Ball bearings 19 limit the forward travel of nut 17. Ball bearings 19 share a common predetermined radius value. This radius value is substantially equal to the radius values defining the curvatures of curved wall 40 of outer conductor 15 and concave rear wall 55 of coupling nut 17.

When placed as shown in FIG. 1, C-ring 21 constrains the rearward motion of nut 17. When C-ring 21 is removed, rearward motion of nut 17 is limited by a front wall 57 of rear cylinder 37. When rear face 42 of nut 17 is against wall 57, aperture 22 is aligned with outer conductor groove 33. With aperture 22 and groove 33 so aligned, ball bearings 19 can be introduced and removed from groove 33 as desired. When C-ring 21 is in place, aperture 22 is forward of groove 33 so that ball bearings 19 cannot escape through aperture 22.

The advantages of the illustrated embodiment are best understood by contrasting it with devices of the background art. These are described below with comparative reference to FIG. 1. The simplest of the background art devices uses a "cap" nut. The device of FIG. 1 could be transformed to such a cap nut device by: (1) removing the ball bearings 19; (2) converting concave surfaces 40 and 55 to vertical walls; (3) extending outward flange 31 of outer conductor 15 and inward flange 51 of nut 17 so that they can engage directly; and (4) adjusting the radial extent of threaded section 47 and rear cylinder 37 so that nut 17 can freely move rearward along outer conductor 15.

An advantage of the cap nut device is that only two components are involved. However, as the nut is threaded onto a receiving connector, the vertical walls replacing the concave surfaces would frictionally engage. The outer conductor front face would grind against the mating front face of the receiving connector, causing the problems discussed in the summary above. The vertical walls act like disk brakes rather than ball bearings. Another disadvantage of this device is that the cap nut must be mounted from the rear, which can complicate the interface between the outer conductor and whatever device is at its rear end.

Alternatively, the background art includes a C-ring locked connector which could be formed by modifying FIG. 1 as follows by: (1) removing ball bearings 19; (2) converting concave walls 40 and 55 to vertical walls; and (3) shrinking C-ring 21 and inserting it into outer conductor groove 33. In this case, the nut can be mounted from the front. The C-ring is compressed with an appropriate tool so that the rear face of the nut can slide over it. The inward flange maintains the compression of the ring during rearward movement of the nut until the nut groove is completely over the C-ring. At that time, the C-ring expands, locking the nut onto the conductor.

A disadvantage of this embodiment is that both vertical walls replacing concave surfaces frictionally engage respective adjacent walls of the C-ring as the nut is tightened onto a receiving connector. In this case, the vertical walls act as front and rear disk brakes instead of bearings. The result, again, is grinding of the front face of the outer conductor and of the receiving connector. Furthermore, since the C-ring is quite inaccessible, it is impracticable to disassemble this connector nondestructively.

Those skilled in the art can understand that there are a variety of ways of constraining the motions of conductors, the nut and the ball bearings. Different surface configurations for the nut and conductors can be accommodated. In addition, different materials and dimensions can be employed. These and other variations on and modifications to the illustrated embodiment are provided for by the present invention, the scope of which is limited only by the following claims.

What is claimed is:

1. A coaxial microwave connector comprising:

a body having an inner conductor and an outer conductor defining a coaxial transmission line therebetween, said outer conductor extending radially and axially, said outer conductor including a front face at a front axial end thereof, said front face consisting primarily of gold, said front face defining a reference plane, said inner conductor extending axially within said outer conductor, said outer conductor having an inner surface and an outer surface, said outer surface including a circumferentially extending conductor segment with a concave axial profile for engaging and constraining the forward movement of ball bearings;

a coupling nut extending axially of said outer conductor so as to intersect said reference plane, said coupling nut having an inner surface, said inner surface including a threaded segment extending at least partially in front of said reference plane, said inner surface including a circumferentially extending nut segment with a concave axial profile for engaging and constraining the rearward movement of ball bearings, said nut segment being disposed behind said conductor segment, said coupling nut including an aperture through which said ball bearings can fit, said aperture being located forward of said nut segment;

ball bearings mechanically coupled to and disposed between said conductor segment and said nut segment; and constraining means for constraining the rearward movement of said nut relative to said body, said constraining means including a removable element which when in place prevents said ball bearings from passing through said aperture.

2. The microwave coaxial connector of claim 1 wherein said ball bearings have a predetermined common radius value, said nut segment and said conductor segment having arcs with radii values substantially equal to said common radius value.

* * * * *